US011453988B2

(12) United States Patent
Lim

(10) Patent No.: US 11,453,988 B2
(45) Date of Patent: Sep. 27, 2022

(54) CRASH CUSHION WITH IMPROVED SIDE PANEL ATTACHMENT

(71) Applicant: LINDSAY TRANSPORTATION SOLUTIONS, LLC, Omaha, NE (US)

(72) Inventor: Jason Lim, Rio Vista, CA (US)

(73) Assignee: LINDSAY TRANSPORTATION SOLUTIONS, LLC, Omaha, NE (US)

( * ) Notice: Subject to any disclaimer, the term of this patent is extended or adjusted under 35 U.S.C. 154(b) by 402 days.

(21) Appl. No.: 16/793,566

(22) Filed: Feb. 18, 2020

(65) Prior Publication Data

US 2021/0254292 A1 Aug. 19, 2021

(51) Int. Cl.
*E01F 15/04* (2006.01)
*E01F 15/08* (2006.01)

(52) U.S. Cl.
CPC ..... *E01F 15/0438* (2013.01); *E01F 15/088* (2013.01); *E01F 15/0423* (2013.01)

(58) Field of Classification Search
CPC ... E01F 15/04; E01F 15/0407; E01F 15/0423; E01F 15/145; E01F 15/146
See application file for complete search history.

(56) References Cited

U.S. PATENT DOCUMENTS 6,536,986 B1 * 3/2003 Anghileri ..... E01F 15/146 404/6
6,811,144 B2 * 11/2004 Denman ..... E01F 15/146 404/6
7,101,111 B2 * 9/2006 Albritton ..... E01F 15/146 404/6
7,396,184 B2 * 7/2008 La Turner ..... E01F 15/146 404/9
7,530,548 B2 * 5/2009 Ochoa ..... E01F 15/0423 404/6
8,858,112 B2 * 10/2014 Wallace ..... E01F 15/0461 404/9
9,051,698 B1 * 6/2015 Anghileri ..... E01F 15/146
2005/0063777 A1 * 3/2005 Smith ..... E01F 15/146 404/6

(Continued)

FOREIGN PATENT DOCUMENTS

CN 110409349 A * 11/2019
CN 110656602 A * 1/2020

(Continued)

*Primary Examiner* — Jonathan P Masinick
(74) *Attorney, Agent, or Firm* — Hovey Williams LLP

(57) ABSTRACT

A crash cushion includes a number of spaced-apart supports or bulkheads, energy-absorbing modules positioned between the supports; and overlapping side panels that interconnect the supports and envelop the energy-absorbing modules. The crash cushion collapses upon itself in an accordion fashion when struck by a vehicle so as to transfer and absorb vehicle impact energy over a predetermined distance. The side panels are attached to the supports and to each other with fastener assemblies. Each fastener assembly comprises a slider bolt, a nut, and a spacer shim. The spacer shim maintain gaps between the slider bolts and the side panels so that the overlapping edges of adjacent side panels are not compressed together regardless of the torque applied to the slider bolt to allow the side panels to collapse and telescope together smoothly when the crash cushion is struck by a vehicle.

20 Claims, 5 Drawing Sheets

(56) References Cited

U.S. PATENT DOCUMENTS

| | | | | |
|---|---|---|---|---|
| 2011/0091273 | A1* | 4/2011 | Sayre | C08G 18/3215 404/6 |
| 2011/0255916 | A1* | 10/2011 | Thompson | E01F 15/145 404/6 |
| 2012/0082511 | A1* | 4/2012 | McKenney | E01F 15/0453 404/6 |
| 2021/0108383 | A1* | 4/2021 | Maus | E01F 15/0423 |

FOREIGN PATENT DOCUMENTS

| | | | | |
|---|---|---|---|---|
| EP | 2418325 | A2 * | 2/2012 | E01F 15/146 |
| EP | 2685003 | A2 * | 1/2014 | E01F 15/146 |
| FR | 2723603 | A1 * | 2/1996 | E01F 15/146 |
| KR | 101022533 | B1 * | 3/2011 | |
| KR | 101420213 | B1 * | 7/2014 | |
| KR | 101445347 | B1 * | 10/2014 | |
| KR | 101448982 | B1 * | 10/2014 | |
| KR | 20180066446 | A * | 6/2018 | |

* cited by examiner

CRASH CUSHION WITH IMPROVED SIDE PANEL ATTACHMENT

BACKGROUND

Vehicle impact absorbing systems, also called "crash cushions," are often installed adjacent rigid structures such as pillars, bridge abutments, lighting poles and the like for absorbing vehicle impact energy and minimizing the effects of impact on a vehicle, the vehicle's occupants, and the structure being protected.

One type of crash cushion includes a number of spaced-apart supports or bulkheads, energy-absorbing modules positioned between the supports, and overlapping side panels that interconnect the supports and envelop the energy-absorbing modules. This type of crash cushion is designed to collapse upon itself in an accordion or telescoping fashion when struck by a vehicle so as to transfer and absorb vehicle impact energy over a predetermined distance.

The side panels are typically attached to the supports and to each other by bolts. The bolts must be properly torqued to securely attach the side panels to the supports while also permitting the side panels to slide and telescope together when the crash cushion collapses upon itself when struck by a vehicle. If the bolts are torqued too little, the side panels may be too loosely attached to the supports and move inadvertently, but if they are torqued too much, the side panels don't slide together in a controlled fashion when the crash cushion is struck by a vehicle, but instead bend or break and prevent the crash cushion form collapsing evenly. Properly torqueing the bolts is time-consuming and may require a special torque wrench.

SUMMARY

The present invention solves the above-described problems and other related problems by providing a crash cushion with improved attachment structure for its side panels and/or other components.

A crash cushion constructed in accordance with an embodiment of the invention broadly comprises a number of spaced-apart supports or bulkheads, energy-absorbing modules positioned between the supports, and overlapping side panels that interconnect the supports and envelop the energy-absorbing modules. The crash cushion may also include front and rear fixed anchors, cable guides in the supports, and reinforcing cables extending between the anchors and through the cable guides. The crash cushion collapses upon itself in an accordion fashion along the length of the cables when struck by a vehicle so as to transfer and absorb vehicle impact energy over a predetermined distance.

In one embodiment, the side panels are formed from corrugated steel guard rail material and each includes a pair of parallel, longitudinally extending slots and a bolt hole adjacent the forward edge of each slot. The side panels are arranged in a telescoping fashion, with the rear edge of one side panel overlapping the front edge of the side panel behind it when viewed from the front of the crash cushion. When assembled, the longitudinally extending slots of each panel align with and overlap the bolt holes on the panel behind it.

The side panels are attached to the supports and to each other with fastener assemblies. Each fastener assembly engages one slot in its corresponding side panel and the aligned bolt hole in the side panel behind it. The fastener assemblies each comprises a spacer shim, a slider bolt, and a nut.

The spacer shim is sized and configured to fit snugly in its corresponding panel slot and includes a bolt hole. In one embodiment, the spacer shims are formed of steel with a Geomet coating and are thicker than the material which forms the side panels.

The slider bolt is inserted in the bolt hole of its corresponding spacer shim and extends through the slot in the corresponding side panel, through the aligned bolt hole in the side panel behind it, through another aligned bolt hole in one of the supports, and into a corresponding nut behind the support. Thus, each spacer shim is sandwiched between the head of its corresponding slider bolt and the side panel closest to the support. Slider flats that serve as sliding washers may be positioned between the heads of the slider bolts and the spacer shims.

The spacer shims maintain small gaps between the heads of the slider bolts (or the slider flats) and the side panels so that adjacent side panels are not compressed together regardless of the torque applied to the slider bolts. This allows the side panels to collapse and telescope together more evenly and smoothly when the crash cushion is struck by a vehicle, resulting in a controlled collapse in a safe manner.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein:

FIG. 1 is a perspective view of a crash cushion constructed in accordance with an embodiment of the invention.

FIG. 2. is a partial exploded perspective view of the crash cushion.

Figure 1:
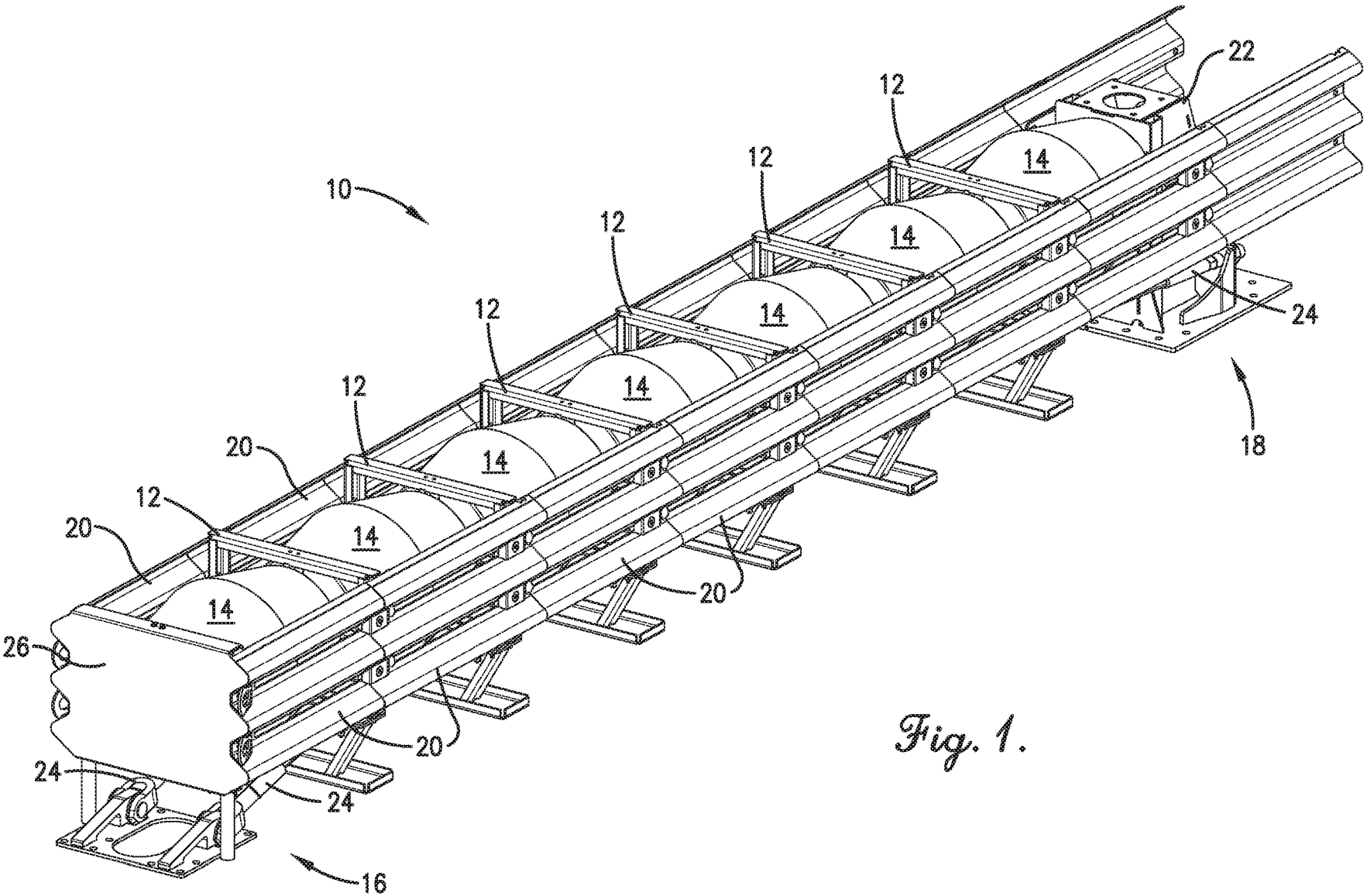

The drawing figures do not limit the present invention to the specific embodiments disclosed and described herein. The drawings are not necessarily to scale, emphasis instead being placed upon clearly illustrating the principles of the invention.

DETAILED DESCRIPTION

Turning now to the drawing figures, and particularly FIG. 1, a crash cushion 10 constructed in accordance with an embodiment of the invention is illustrated. The crash cushion 10 may be installed adjacent a rigid structure such as a pillar, bridge abutment, lighting pole, or the like for absorbing vehicle impact energy and minimizing the effects of impact on a vehicle, the vehicle's occupants and the structure being protected.

An embodiment of the crash cushion 10 broadly comprises a number of spaced-apart supports 12 or bulkheads; energy-absorbing modules 14 positioned between the supports; a front anchor structure 16; a rear anchor structure 18; and side panels 20.

The supports 12 stand upright and are spaced along the longitudinal axis of the crash cushion 10. The supports 12 are configured to telescopically slide together along the length of the crash cushion when the crash cushion is struck by a vehicle as described below. The crash cushion 10 also includes a substantially immovable support frame 22 fixedly anchored in a rearmost position relative to the other spaced supports 12.

The energy-absorbing modules 14 are disposed between and supported by the supports 12, 22. In the illustrated embodiment, the modules 14 are aligned between the supports 12, 22 along the longitudinal axis of the crash cushion. Any number of supports and modules may be provided to form a crash cushion of any desired length and crash rating.

In one embodiment, the energy absorbing modules 14 are formed of molded plastic or other similar materials and are filled with foam, water, or other liquid and/or gaseous materials. Some of the modules 14 may include elongated narrow openings or slots formed therein that define deformable side wall strips which bend responsive to application of opposed forces such as might be caused by a vehicle impacting the crash cushion 10. Similarly, some of the modules may include holes, which encourages creation of folds in the modules when subjected to vehicle impacts.

The front anchor structure 16 and rear anchor structure 18 are fixed in position and essentially immovable. The anchor structures may be bolted to blocks of concrete embedded in the ground. The immoveable support 22 is bolted to or otherwise fixedly secured to the rear anchor structure 18.

Extending between the front and rear anchor structures 16, 18 are reinforcing cables 24. Cable guide structures may be formed in the supports 12, with cable passageways sized to allow relative slidable movement between the cables 24 and the supports 12 upon application of suitable forces to the crash cushion 10. The anchors 16, 18 and cables 24 help maintain the initial, non-crash position of the supports 12 and keep them from rotating about their vertical axes when moving rearward responsive to a frontal impact on the crash cushion.

Figure 2:
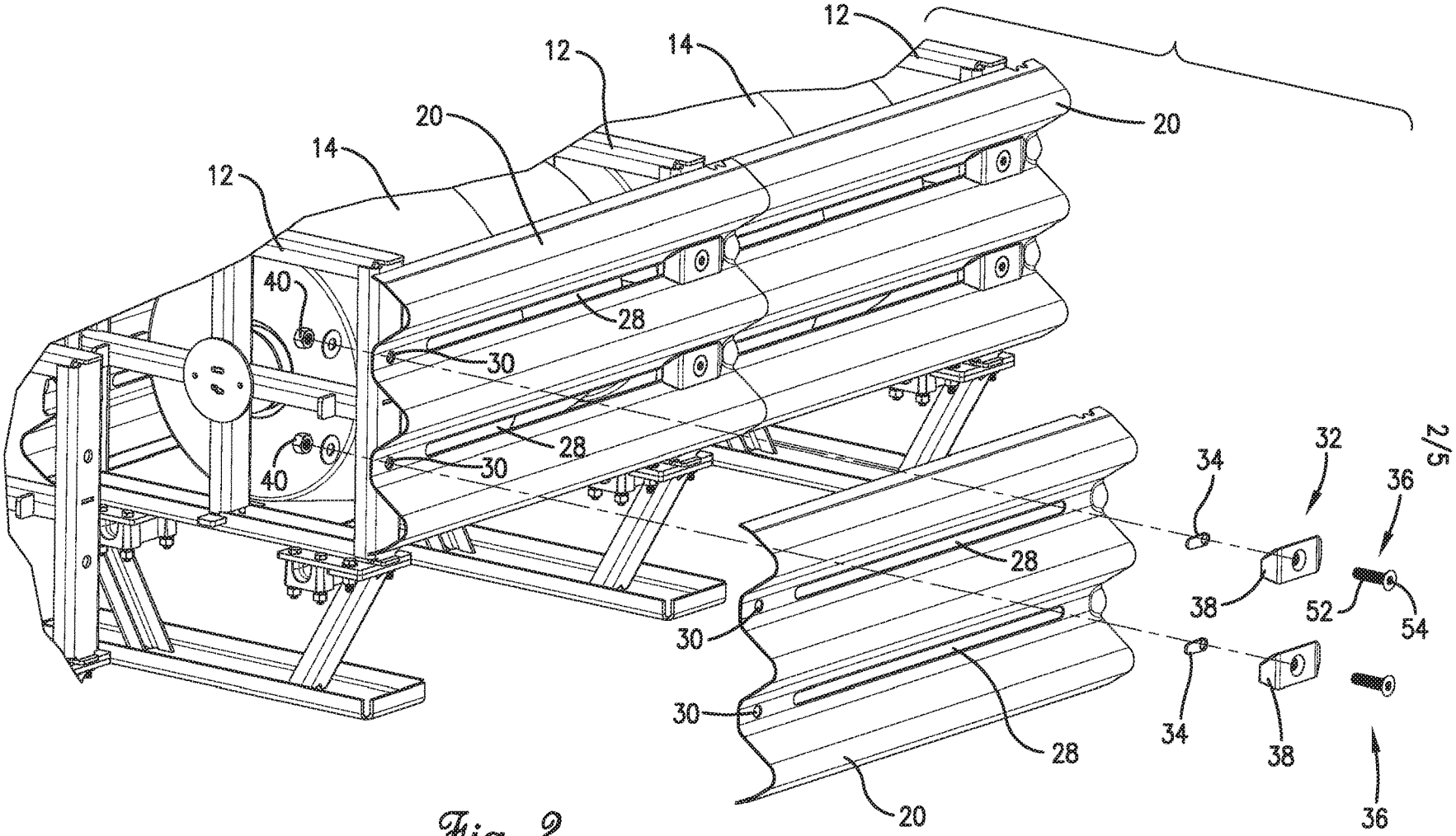
Figure 3:
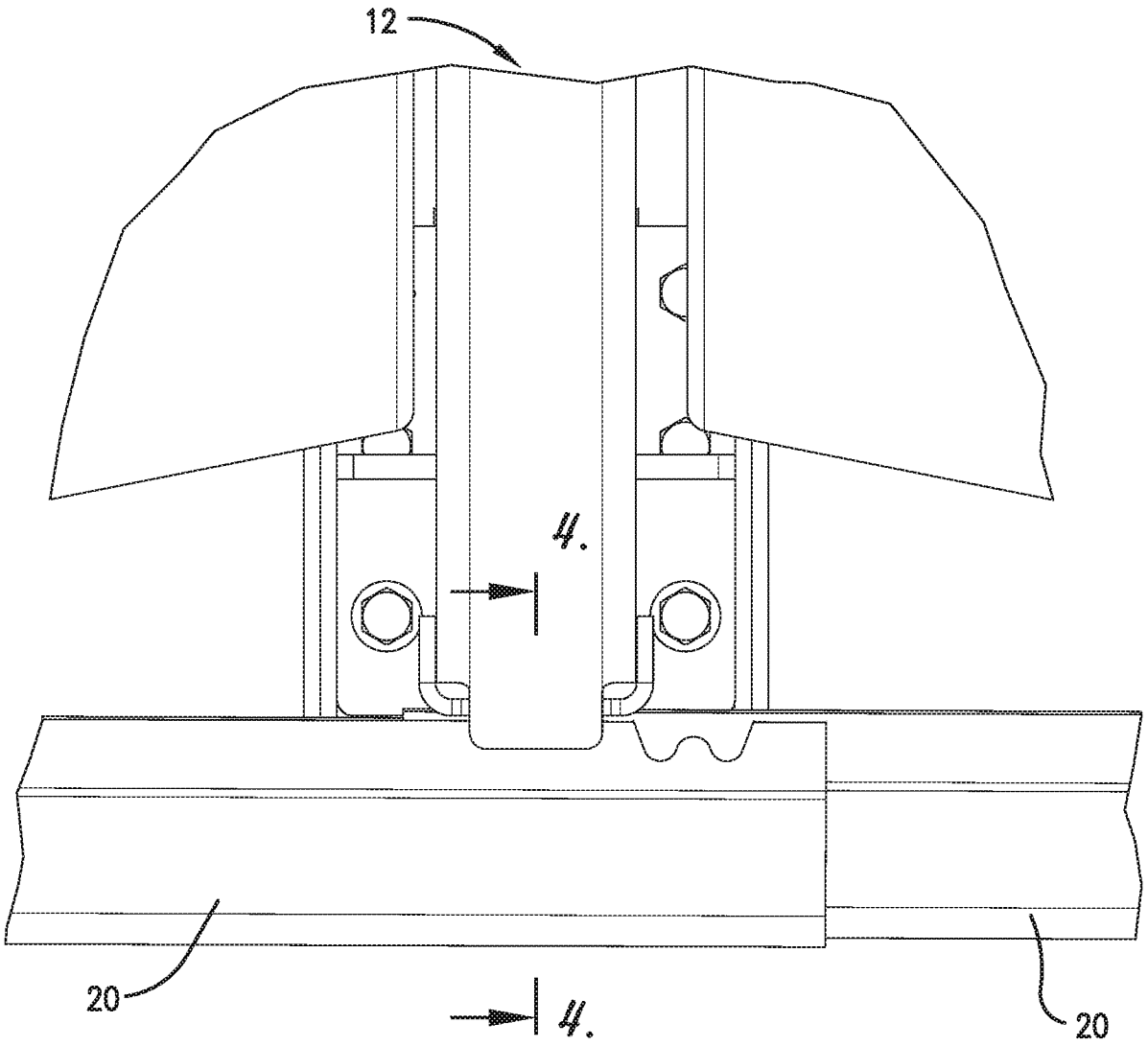
FIG. 3 is a partial top view of the crash cushion.

The side panels 20 interconnect the supports 12, 22 and envelop the energy-absorbing modules 14. As best shown in FIGS. 2 and 3, the side panels 20 are arranged in an overlapping and telescoping fashion, with the rear edge of each side panel overlapping the front edge of the side panel behind it when viewed from the front of the crash cushion.

A front impact member or nose 26 is located at the forward end of the crash cushion 10 and may be connected to the leading edges of the two forwardmost side panels 20.

As best shown in FIG. 2, embodiments of the side panels 20 are formed from corrugated steel guard rail material, and each includes a pair of parallel, longitudinally extending slots 28 and a bolt hole 30 adjacent the forward edge of each slot. When placed in the illustrated overlapping orientation, the longitudinally extending slots 28 on a side panel align with and overlap the bolt holes on the panel behind it.

As depicted in FIG. 2, the side panels 20 are attached to the supports 12, 22 and to each other with novel fastener assemblies 32. Each fastener assembly 32 engages one slot 28 in a side panel 20 and the aligned bolt hole 30 in the side panel behind it and comprises a spacer shim 34, a slider bolt 36, a slider flat 38, and a nut 40.

Figure 5:
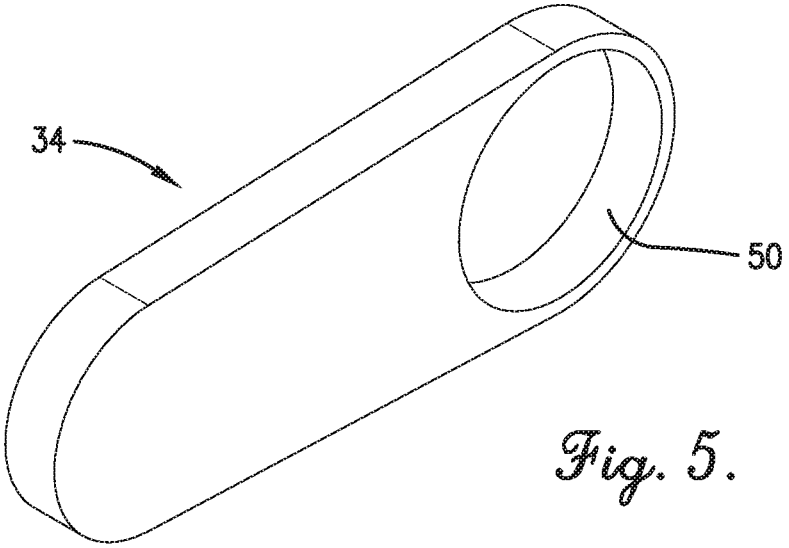
FIG. 5 is a perspective view of an embodiment of a spacer shim incorporated in the crash cushion.
Figure 6:
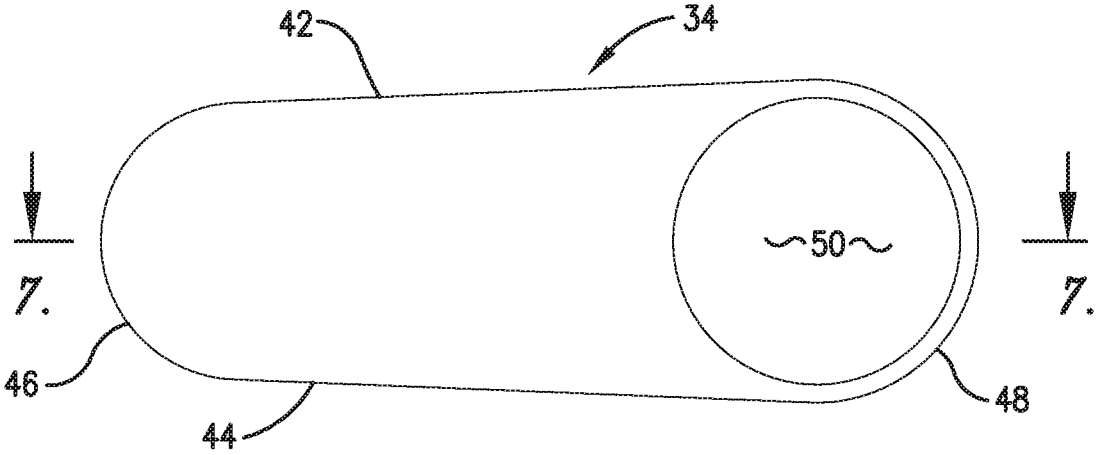
FIG. 6 is an elevational view of the spacer shim.
Figure 7:
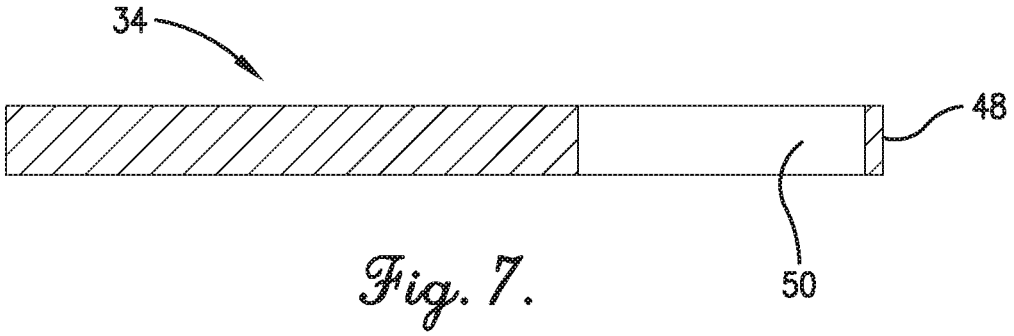
FIG. 7 is a sectional view of the spacer shim taken along line 7/7 of FIG. 6.

Each spacer shim 34 is sized and configured to snugly fit in its corresponding panel slot 28. A spacer shim 34 constructed in accordance with an embodiment of the invention is shown in FIGS. 5-7. The spacer shim 34 includes two straight sides 42, 44 connected by rounded or curved edges 46, 48. The straight sides 42, 44 diverge from left to right when viewed from the perspective of FIG. 6 such that the right edge 48 is taller than the left edge 46, the purpose of which is explained below. The spacer shim 34 is thicker than the materials used to form the side panels 12, 22, the significance of which is explained below. A bolt hole 50 is formed adjacent the wider side of the spacer shim for receiving the shaft of the slider bolt as described below. The spacer shims are preferably formed of steel with a Geomet coating but may be made of other materials and/or with other coatings. In one embodiment, each spacer shim is 2⅜" long as measured between edges 46, 48; ⅜" thick; ¾" tall at the shorter edge 46, and ⅞" tall at the taller edge 48.

The present invention is not limited to the specific embodiments of the spacer shims 34 described and illustrated in this application. The spacer shims 34 may be replaced with other components which achieve the same functions.

Each slider bolt 36 includes a shaft 52 and a head 54. Each slider flat 38 includes a flat washer surface with a bolt hole in it and a pair of side wings. The shaft 52 of the slider bolt 36 is inserted through the slider flat 38, through the bolt hole of its spacer shim 34, through the slot 28 of one side panel, through the aligned bolt hole 30 in the side panel behind it, through another aligned bolt hole in the corresponding support 12, and into the nut 40 behind the support.

Figure 4:
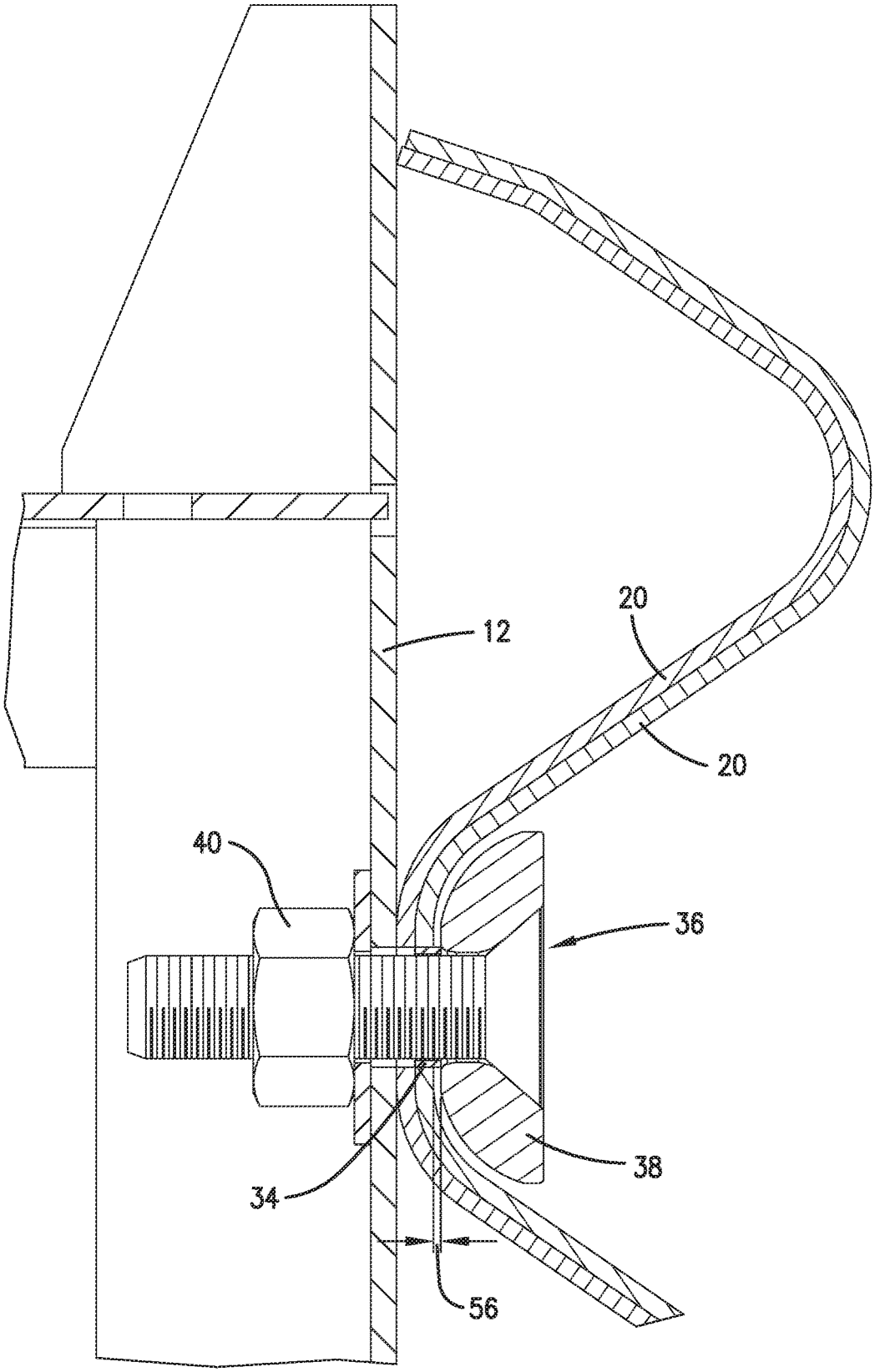
FIG. 4 is a partial cross sectional view of the crash cushion taken along line 4/4 of FIG. 3.

As best illustrated in FIG. 4, each spacer shim 34 is sandwiched between its corresponding slider flat 38 and the side panel 20 closer to the support 12. Because the spacer shims 34 are thicker than the material used to form the side panels 20, each spacer shim 34 maintains a small gap 56 between its corresponding slider flat and the exterior surface of the side panel closest to the head of the slider bolt. This prevents the slider bolt from compressing the side panels together regardless of the torque applied to the slider bolt so that the side panels may more freely collapse and telescope together along the longitudinal axis of the crash cushion when it is struck by a vehicle. The specific shape of the spacer shims 34 shown in FIGS. 5-7 also facilitate the sliding telescopic movement of the side panels 20. Specifically, because the left edges 46 of the spacer shims are shorter than the right edges 48, the spacer shims experience less friction when sliding leftward in the slots 28 when viewed from the perspective of FIG. 2 to permit the supports 12 and side panels 20 to more smoothly collapse when the crash cushion is struck by a vehicle.

FIG. 7 of U.S. Pat. No. 6,811,144, which illustrates a similar crash cushion, and which is incorporated into the present application in its entirety by reference, illustrates by arrows the application of an endwise force on the crash cushion, as for example caused by vehicle impact. The first module to collapse will be the forward most module. The modules disposed behind the front or forward most module will collapse in a generally accordion fashion, providing significantly greater resistance to the impact.

Although the invention has been described with reference to the preferred embodiment illustrated in the attached drawing figures, it is noted that equivalents may be employed and substitutions made herein without departing from the scope of the invention as recited in the claims.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A crash cushion for absorbing energy when impacted by a vehicle, the crash cushion comprising:

a plurality of supports;

a plurality of energy absorbing modules disposed between and supported by the supports;

at least two side panels that interconnect the supports and envelop the energy-absorbing modules, each side panel including an elongated slider slot and a bolt hole, the side panels positioned in an overlapping orientation with a rear edge of a first one of the side panels overlapping a front edge of a second one of the side panels such that the elongated slider slot in the first side panel is aligned with the bolt hole on the second side panel; and fastener assemblies for attaching the side panels to the supports and to each other, each fastener assembly comprising:

a spacer shim placed in the elongated slot of the first side panel, and a slider bolt having a head and a shaft, the shaft inserted through the slider slot in the first panel, through the spacer shim, and through the bolt hole in the second side panel, such that the spacer shim is sandwiched between the head of the slider bolt and the second side panel and creates a gap between the head of the slider bolt and the first side panel so that the first and second side panels are not compressed together by the slider bolt and telescopically slide relative to one another.

2. The crash cushion as set forth in claim 1, wherein the spacer shim has a thickness greater than a material thickness of the first and second side panels.

3. The crash cushion as set forth in claim 1, each fastener assembly further comprising a nut for threadedly engaging the shaft of slider bolt.

4. The crash cushion as set forth in claim 1, wherein the spacer shim includes two straight sides connected by curved ends.

5. The crash cushion as set forth in claim 4, wherein the spacer shim includes a bolt hole through it.

6. The crash cushion as set forth in claim 4, wherein the straight sides of the spacer shim diverge so that a right edge of the spacer shim is taller than a left edge of the spacer shim.

7. The crash cushion as set forth in claim 1, wherein the fastener assemblies each further comprise a slide flat positioned between the slider bolt and the spacer shim.

8. The crash cushion as set forth in claim 1, further comprising:

front anchor structure;

rear anchor structure spaced from the front anchor structure, the energy absorbing modules and the supports being positioned between the front anchor structure and the rear anchor structure;

cable guide structures integrated in the supports; and at least one cable affixed to the front anchor structure and the rear anchor structure and extending through the cable guide structures.

9. A crash cushion for absorbing energy when impacted by a vehicle, the crash cushion comprising:

a plurality of supports;

a plurality of energy absorbing modules disposed between and supported by the vertical spaced supports;

at least two side panels that interconnect the supports and envelop the energy-absorbing modules, each side panel including an elongated slider slot and a bolt hole, the side panels positioned in an overlapping orientation with a rear edge of a first one of the side panels overlapping a front edge of a second one of the side panels such that the elongated slider slot in the first side panel is aligned with the bolt hole on the second side panel; and fastener assemblies for attaching the side panels to the supports and to each other, each fastener assembly comprising:

a spacer shim placed in the elongated slot of the first side panel, the spacer shim having a bolt hole, a slider bolt having a head and a shaft, the shaft inserted through the bolt hole in the spacer shim and through the bolt hole in the second side panel, and a nut for threadably engaging the shaft of slider bolt such that when the slider bolt is torqued against the nut, the spacer shim is sandwiched between the head of the slider bolt and the second side panel and creates a gap between the head of the slider bolt and the first side panel so that the first and second side panels telescopically slide relative to one another;

front anchor structure;

rear anchor structure spaced from the front anchor structure, the energy absorbing modules and the supports being positioned in front of the rear anchor structure;

cable guide structures integrally formed in the supports; and at least one cable affixed to the front anchor structure and the rear anchor structure and extending therebetween, and supported by the cable guide structures.

10. The crash cushion as set forth in claim 9, wherein the spacer shim has a thickness greater than a material thickness of the first and second side panels.

11. The crash cushion as set forth in claim 9, wherein the spacer shim includes two straight sides connected by curved ends.

12. The crash cushion as set forth in claim 11, wherein the spacer shim includes a bolt hole through it.

13. The crash cushion as set forth in claim 9, wherein the straight sides of the spacer shim diverge so that a right edge of the spacer shim is taller than a left edge of the spacer shim.

14. The crash cushion as set forth in claim 9, wherein the fastener assemblies each further comprise a slide flat positioned between the slider bolt and the spacer shim.

15. A crash cushion for absorbing energy when impacted by a vehicle, the crash cushion comprising:

a plurality of supports;

a plurality of energy absorbing modules disposed between and supported by the vertical spaced supports;

at least two side panels that interconnect the supports and envelop the energy-absorbing modules, each side panel including an elongated slider slot and a bolt hole, the side panels positioned in an overlapping orientation with a rear edge of a first one of the side panels overlapping a front edge of a second one of the side panels such that the elongated slider slot in the first side panel is aligned with the bolt hole on the second side panel; and fastener assemblies for attaching the side panels to the supports and to each other, each fastener assembly comprising:

a spacer shim placed in the elongated slot of the first side panel, the spacer shim having a bolt hole, a slider bolt having a head and a shaft, a slider flat, the shaft of the slider bolt inserted through the slider flat, through the bolt hole in the spacer shim, and through the bolt hole in the second side panel, and a nut for threadably engaging the shaft of slider bolt such that when the slider bolt is torqued against the nut, the spacer shim is sandwiched between the slider flat and the second side panel and creates a gap between the slider flat and the first side panel so that the first and second side panels are not compressed together;

front anchor structure;

rear anchor structure spaced from the front anchor structure, the energy absorbing modules and the supports being positioned in front of the rear anchor structure;

cable guide structures integrally formed in the supports; and at least one cable affixed to the front anchor structure and the rear anchor structure and extending therebetween, and supported by the cable guide structures.

16. The crash cushion as set forth in claim 15, wherein the spacer shim has a thickness greater than a material thickness of the first and second side panels.

17. The crash cushion as set forth in claim 15, wherein the spacer shim includes two straight sides connected by curved ends.

18. The crash cushion as set forth in claim 17, wherein the spacer shim includes a bolt hole through it.

19. The crash cushion as set forth in claim 17, wherein the straight sides of the spacer shim diverge so that a right edge of the spacer shim is taller than a left edge of the spacer shim.

20. The crash cushion as set forth in claim 15, wherein the fastener assemblies do not compress the side panels regardless of torque applied to the slider bolt.

* * * * *